US006352069B1

(12) United States Patent
Kraus et al.

(10) Patent No.: US 6,352,069 B1
(45) Date of Patent: Mar. 5, 2002

(54) IGNITION COIL FOR INTERNAL COMBUSTION ENGINES

(75) Inventors: Markus Kraus; Franz Pockstaller, both of Jenbach (AT)

(73) Assignee: Jenbacher Aktiengesellschaft (AT)

( * ) Notice: Subject to any disclaimer, the term of this patent is extended or adjusted under 35 U.S.C. 154(b) by 0 days.

(21) Appl. No.: 09/542,263

(22) Filed: Apr. 4, 2000

(30) Foreign Application Priority Data

Apr. 8, 1999 (AT) ..... 623/99

(51) Int. Cl.[7] ..... F02P 3/02
(52) U.S. Cl. ..... 123/622; 123/634
(58) Field of Search ..... 123/621, 622, 123/634, 635

(56) References Cited

U.S. PATENT DOCUMENTS

| | | | | | |
|---|---|---|---|---|---|
| 2,301,758 | A | * | 11/1942 | Smith et al. | 123/621 |
| 3,760,782 | A | * | 9/1973 | Meyer et al. | 123/621 X |
| 3,919,993 | A | | 11/1975 | Neuman | 123/620 |
| 3,926,557 | A | * | 12/1975 | Callies et al. | 123/621 X |
| 4,140,946 | A | * | 2/1979 | Gerry | 123/622 X |
| 4,345,575 | A | | 8/1982 | Jorgensen | 123/598 |
| 4,369,756 | A | | 1/1983 | Ezoe | 123/620 |
| 5,003,958 | A | * | 4/1991 | Yoneyama et al. | 123/635 |
| 5,008,643 | A | | 4/1991 | Hertier-Best et al. | 336/96 |
| 5,140,970 | A | | 8/1992 | Akaki et al. | 123/620 |
| 5,228,425 | A | | 7/1993 | Simons | 123/620 |
| 5,404,860 | A | | 4/1995 | Morino et al. | 123/605 |
| 5,806,504 | A | * | 9/1998 | French et al. | 123/622 X |
| 5,806,505 | A | | 9/1998 | Herbert et al. | 123/621 |

FOREIGN PATENT DOCUMENTS

| | | | | |
|---|---|---|---|---|
| DE | 2154792 A | | 11/1972 | |
| DE | 4208706 A1 | | 9/1993 | |
| GB | 2044846 | * | 10/1980 | 123/622 |
| JP | 09045554 A | | 2/1997 | |

* cited by examiner

*Primary Examiner*—Tony M. Argenbright
(74) *Attorney, Agent, or Firm*—Lorusso & Loud

(57) ABSTRACT

Ignition coil for internal combustion engines with two or more transformer stages connected in a cascade arrangement one behind another.

6 Claims, 5 Drawing Sheets

IGNITION COIL FOR INTERNAL COMBUSTION ENGINES

BACKGROUND OF THE INVENTION

The invention relates to an ignition coil for internal combustion engines.

In the case of ignition coils, a high voltage of up to 50 kV must be produced in a very limited space.

In order to obtain a long useful life, the coil must be insulated as well as possible, a construction not producing partial discharges being ideal. Because of the electrical insulation, a coil with low partial discharges is very bulky. The magnetic leakage fields are large with conventional solutions, and the magnetic coupling between the primary and secondary coil is poor.

BRIEF SUMMARY OF THE INVENTION

The object of the invention is to provide a coil improved with respect to useful life and to a compact construction.

According to the invention, this is obtained by means of an ignition coil for internal combustion engines that is characterised by two or more transformer stages connected in a cascade arrangement one behind another, wherein the secondary windings of all the transformer stages are connected in series onto a spark plug.

With such a construction, the individual transformer stages can be constructed more compactly, as the high voltage required is produced in several stages, wherein the individual stages can easily be insulated one from another. In the respective stages themselves, the voltages are lower with respect to one another, whereby the gaps between the windings can be minimised. As a result, a better magnetic coupling is obtained. Leakage fields can be reduced. With this multiple stage construction, the required insulation gaps are smaller, which allows a closed iron core, or respectively a general ferromagnetic core, to be used in each individual transformer stage, while at the same time preserving a relatively compact construction. In this way the magnetic flux can be better controlled.

In addition to a more compact construction, the ignition coil according to the invention is also characterised by a longer useful life, in particular as, due to lower voltages, it is easier to prevent partial discharges via the insulator.

Furthermore, the cascade arrangement allows a large degree of freedom in the sizing of the ignition coil, both from the electrical point of view and from the point of view of the mechanical construction. It is thus possible, for example, to arrange the individual transformer stages geometrically in almost any arrangement with respect to one another. An arrangement in which the individual transformer stages are "threaded" one behind another on a common imaginary axis is advantageous. There are, however, other possibilities for arrangement. From the electrical point of view, an adaptation to the prevailing conditions can be made, for example, by different transformation ratios in the individual transformer stages. It is also possible to size the input side transformer stages with respect to the volume of the core and the wire thickness of the windings smaller than the output side stages, which allows a more compact and slimmer mode of construction in the output area.

It is also possible to feed the primary winding of the transformer stages using separate voltage sources, for example, by means of a capacitor circuit or a high-frequency ignition circuit. Essentially, the ignition coil according to the invention is suitable in the most different of configurations, both for capacitor ignition circuits and for high-frequency ignition circuits, wherein there is particular suitability for high-frequency ignition circuits, which can transmit frequencies up to the 100 kHz range. Further advantages and details of the invention will be explained with reference to the following description of the drawings.

DETAILED DESCRIPTION OF THE INVENTION

Figure 1:
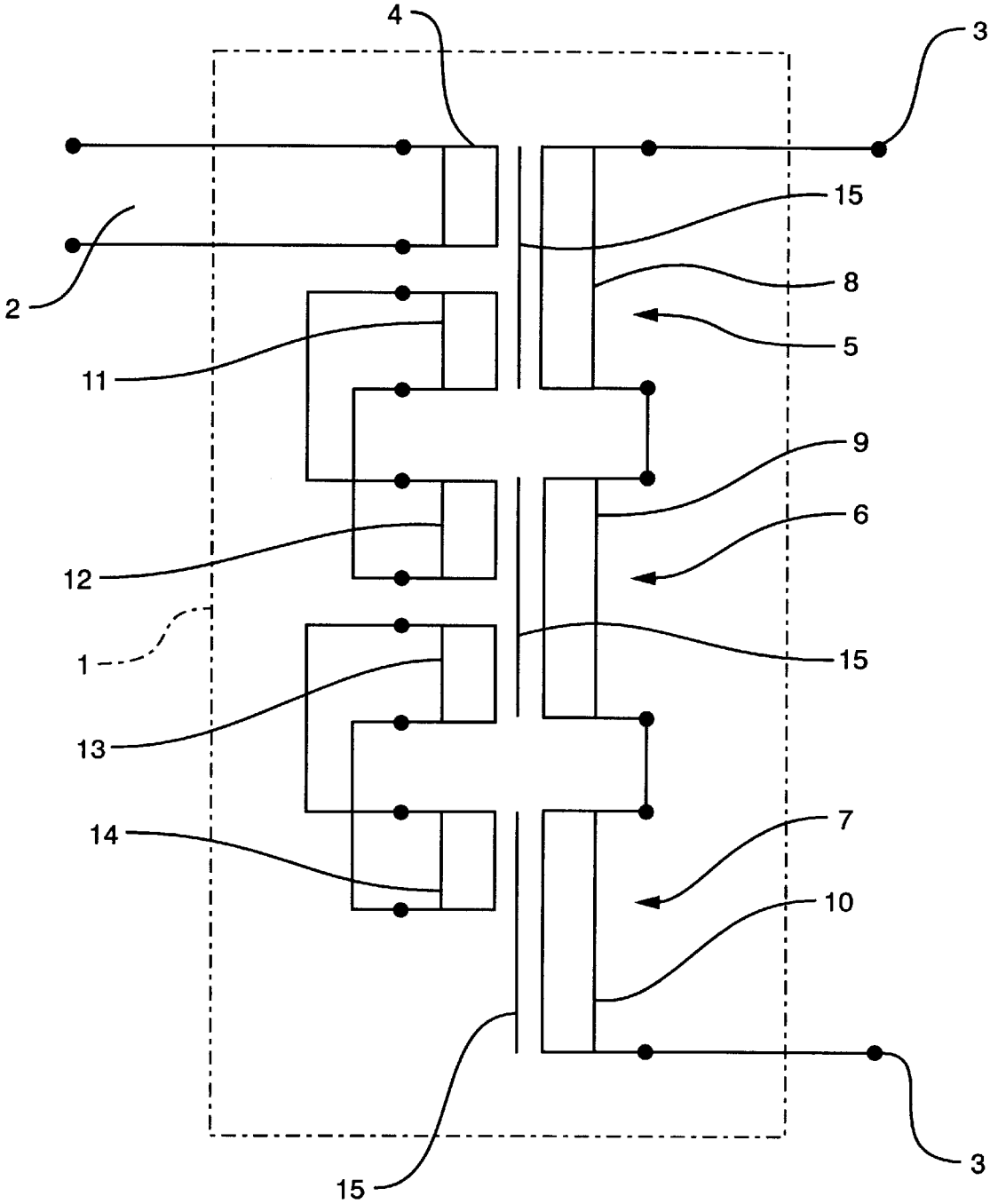
FIG. 1 shows schematically the electrical construction of an embodiment of an ignition coil according to the invention.

The ignition coil 1 shown in FIG. 1 has a primary side terminal 2 and a secondary side terminal 3, on which the high voltage is present. On the primary side there can be connected, for example, a capacitor ignition circuit or a high-frequency ignition circuit, known per se, which results in a voltage pulse in the first primary winding 4 of the first transformer stage 5. In this embodiment there are altogether three transformer stages 5, 6, and 7 connected in a cascade arrangement one behind another, wherein the secondary windings 8, 9 and 10 of the transformer stages 5, 6 and 7 are connected in series behind one another, so that the voltages induced in the individual secondary windings 8, 9 and 10 add together to form the output voltage on the terminals 3.

On the primary side the individual transformer stages 5, 6 and 7 are coupled respectively via connected primary windings 11, 12 and respectively 13, 14, wherein the transformation ratios in the individual transformer stages can be equal, or, in order to adapt to particular requirements, different.

The ferromagnetic core of each transformer stage 5, 6, and 7 is labelled 15, and is shown only schematically in FIG. 1.

Figure 2:
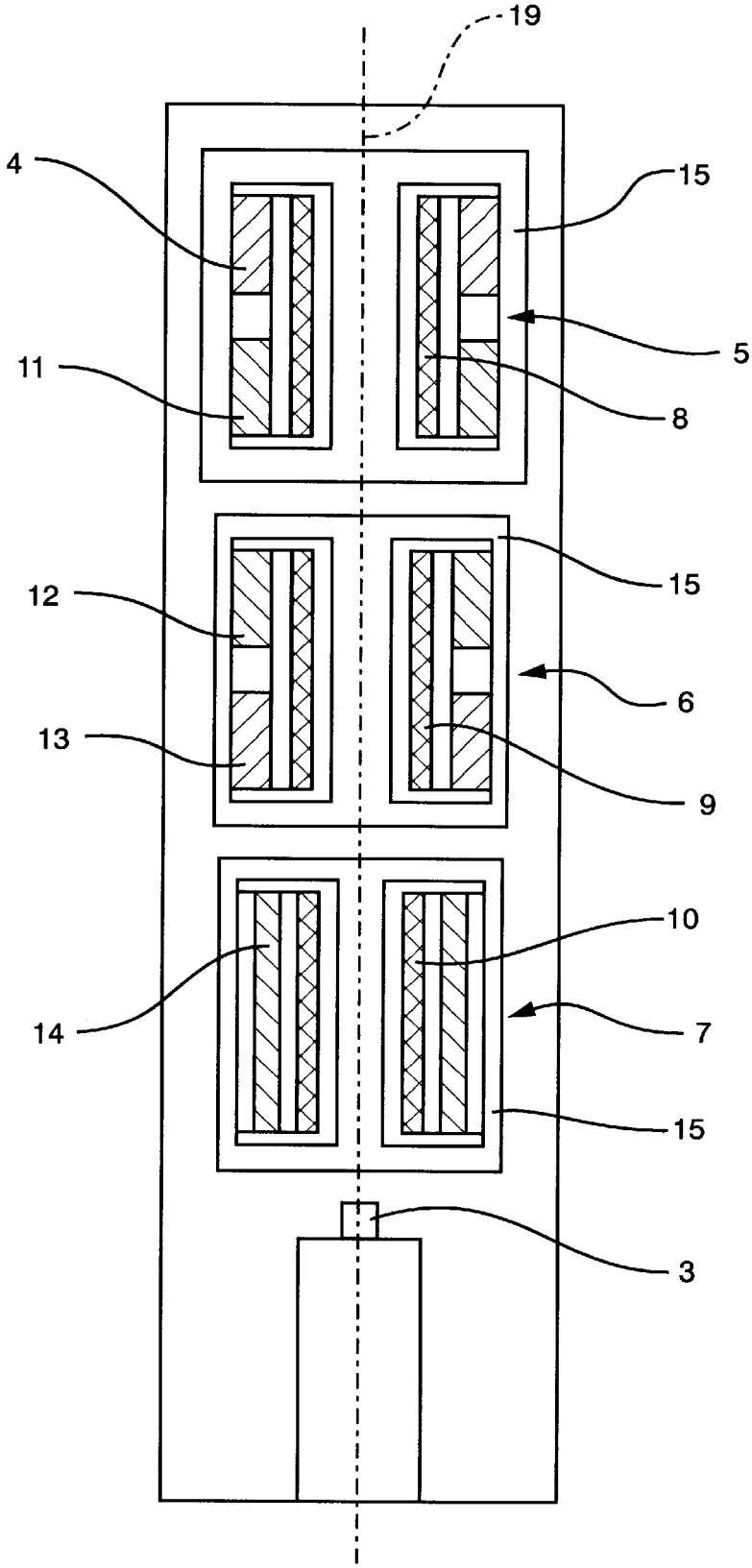
FIG. 2 shows an embodiment for a mechanical construction of an ignition coil according to the invention in a central longitudinal section, wherein the lines according to the invention connecting the individual windings according to FIG. 1 are not shown in FIG. 2 for reasons of clarity, or respectively lie outside the sectional plane.
Figure 3:
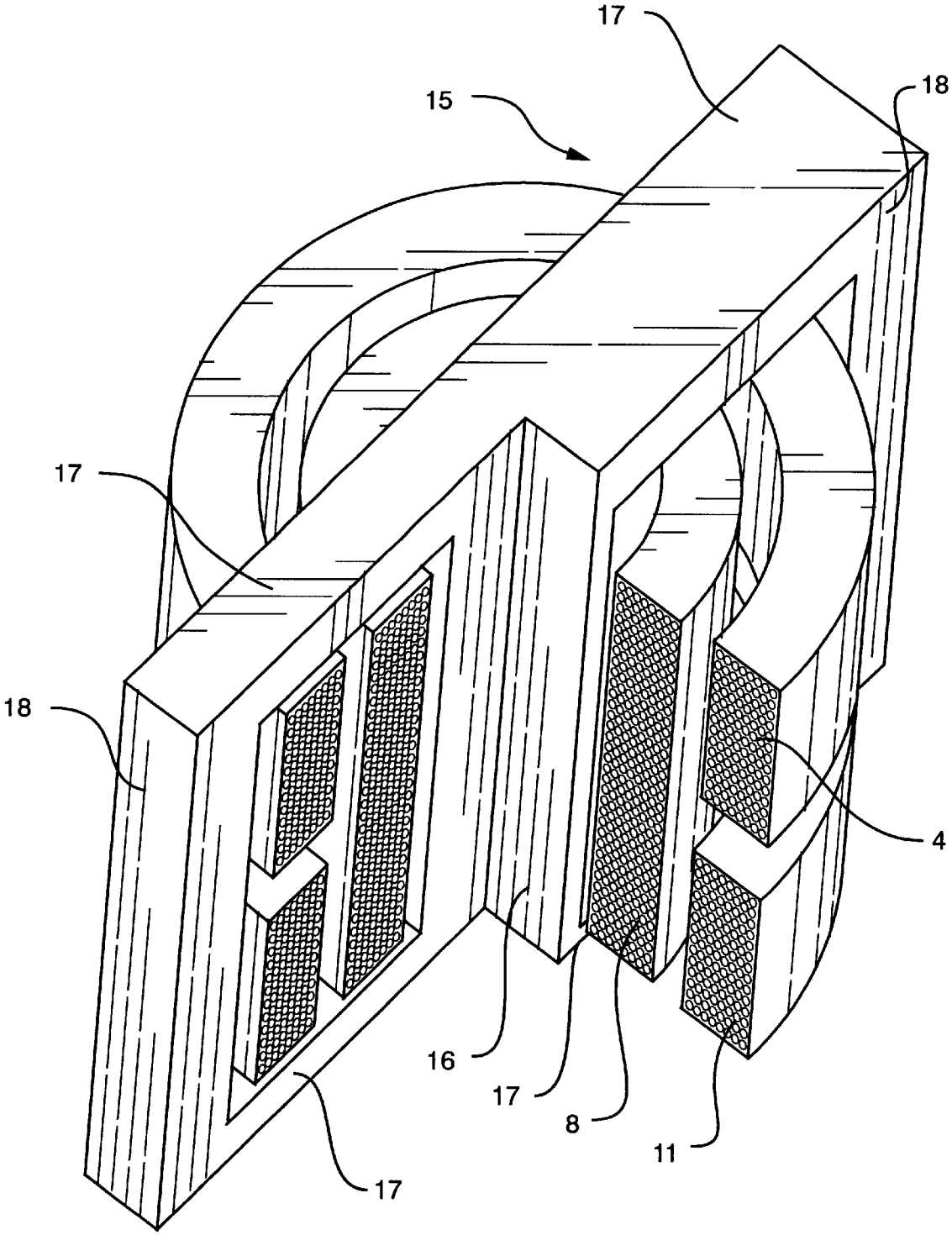
FIG. 3 shows a partly cut-away representation in perspective of the schematic construction of an embodiment of a transformer stage of an ignition coil according to the invention.

FIG. 2 shows an embodiment for an actual construction with three transformer stages 6, 7, connected one behind another, wherein it is particularly clear that the ferromagnetic core 15 is configured as a closed core. In the embodiment shown, each stage is configured as a shell-type transformer, in which the secondary winding and the primary windings are wound concentrically about the same leg of the ferromagnetic core 15. This can be seen particularly well in FIG. 3, in which this leg is labelled with the reference sign 16. The secondary winding 8 is wound on the inside about this leg, the primary windings 4 and 11 are wound around concentrically on the outside. On each side of this leg 16 there project two yokes 17, which are each connected via a non-wound leg 18 into a closed ferromagnetic circuit with the wound leg 16. Altogether, there is thus produced a doubly closed ferromagnetic core 15.

Figure 5:
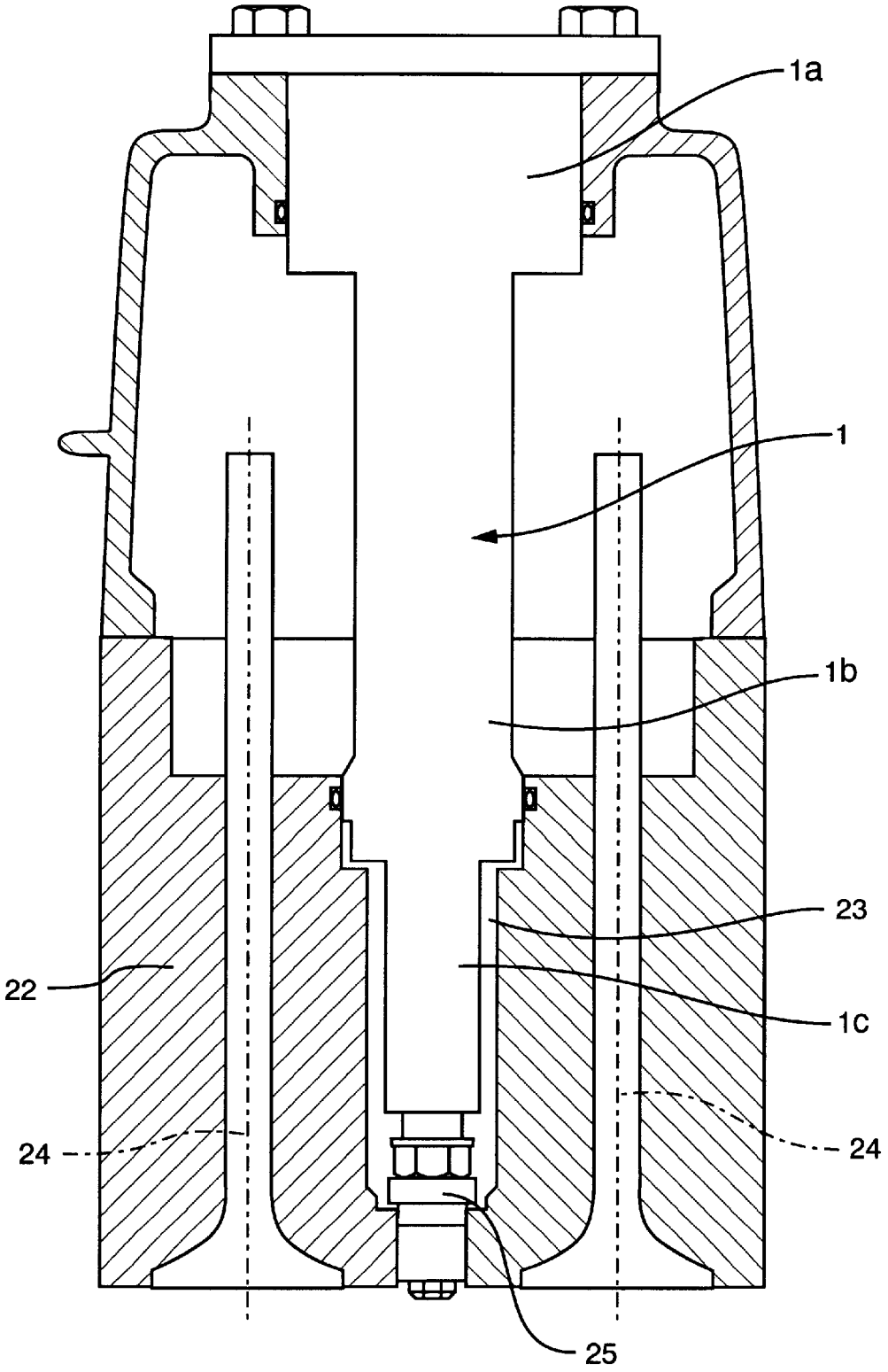
FIG. 5 shows the assembly of an ignition coil according to the invention in a cylinder head.

As the rear transformer stages no longer have to transmit the whole of the energy, these can be configured smaller, on the one hand with respect to the volume of the ferromagnetic core, but also the load-carrying capacity of the primary winding. This is indicated in FIG. 2. Such a structure allows, inter alia, saving of material and where needed a more compact external measurement, and offers more possibilities for design in the construction of the ignition coil. This can result in the ignition coil being at least partially inserted into the free space 23 between the inlet and outlet valves 24 of a cylinder head 22, whereby accommodation in a space-saving manner is possible, and moreover, the gap to the spark plug 25 is reduced (see FIG. 5). The ignition coil 1 in this case has three housing sections 1*a*, 1*b* and 1*c* of different diameters.

In the embodiment shown in FIG. 2, the primary windings 4, 11, 12, 13 and 14, and the secondary windings 8, 9 and 10 of all the transformer stages 5, 6 and 7 are wound about a common imaginary axis 19, wherein the individual transformer stages 5, 6 and 7 are each arranged at a distance apart along this axis. The terminal 3 for picking up the high voltage can then still be arranged on this axis.

Figure 4:
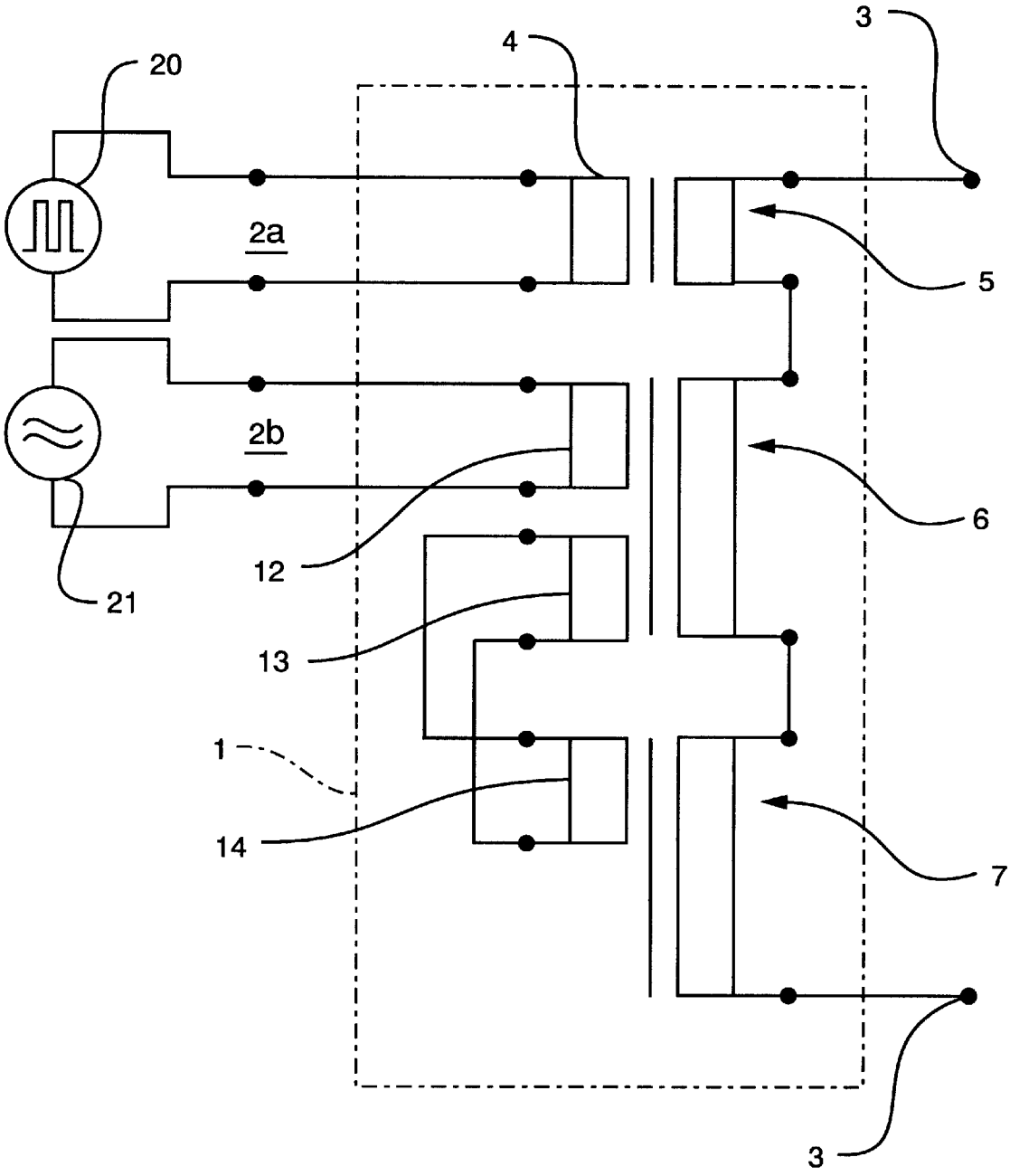
FIG. 4 shows the electrical construction of a further embodiment with two separate voltage sources.

The embodiment shown in FIG. 4 shows a version with two voltage sources, which are separated from one another. One is configured as a high-frequency ignition circuit 20, the other as a capacitor ignition circuit 21. There are respectively provided separated primary side terminals 2*a* and 2*b*. The ignition coil itself is in turn provided with three transformer stages 5, 6 and 7 connected in a cascade arrangement one behind another, wherein the secondary windings are connected in series. On the primary side, the voltage source 20 feeds the primary winding 4 of the first stage 5, while the voltage source 21 feeds the primary winding 12 of the second stage 6. This second stage 6 is coupled via the primary windings 13 and 14 to the third stage 7. The high-frequency ignition circuit 12 and respectively the capacitor ignition circuit 21 do not need to be described in more detail. These circuits can be constructed according to the state of the art.

The invention is naturally not limited to the embodiments shown, for example, two or more than three cascade type transformer stages can be used. The spatial arrangement of the transformer stages with respect to one another can also differ from the linear orientation thereof as provided in FIG. 2.

What is claimed is:

1. An Ignition coil for internal combustion engines comprising:

two or more transformer stages connected in a cascade arrangement one behind another, the secondary windings of all the transformer stages being connected in series to a spark plug, wherein at least one transformer stage is provided with two primary windings, one of which is connected to an ignition coil input or a primary winding of a preceding transformer stage, and the second of which is connected to the primary winding of a subsequent transformer stage.

2. An ignition coil for internal combustion engines comprising:

two or more transformer stages connected in a cascade arrangement one behind another, the secondary windings of all the transformer stages being connected in series to a spark plug, wherein the primary windings and secondary windings of the transformer stages are respectively arranged in a closed magnetic core.

3. The ignition coil according to claim 2, wherein at least one transformer stage is configured having the secondary winding and the primary winding wound concentrically about the same leg of a ferromagnetic core, wherein on both sides of this leg two yokes project which each are connected to the wound central leg via a non-wound leg forming a closed ferromagnetic circuit.

4. An ignition coil for internal combustion engines comprising:

two or more transformer stages connected in a cascade arrangement one behind another, the secondary windings of all the transformer stages being connected in series to a spark plug, wherein the transformation ratios of the individual transformer stages are different.

5. An ignition coil for internal combustion engines comprising:

two or more transformer stages connected in a cascade arrangement one behind another, the secondary windings of all the transformer stages being connected in series to a spark plug, wherein at least a subsequent transformer stage is sized smaller than the preceding transformer stage with respect to the volume of the ferromagnetic core or the wire thickness of matching primary windings.

6. An ignition coil for internal combustion engines comprising:

two or more transformer stages connected in a cascade arrangement one behind another, the secondary windings of all the transformer stages being connected in series to a spark plug, wherein the primary windings and secondary windings of all the transformer stages are wound concentrically about a common imaginary axis, wherein the individual transformer stages are respectively arranged at a distance apart along this axis.

* * * * *